US005821042A

United States Patent [19]

Massirio et al.

[11] Patent Number: 5,821,042

[45] Date of Patent: Oct. 13, 1998

[54] SILVER HALIDE COLOR PHOTOGRAPHIC ELEMENT HAVING IMPROVED BLEACHABILITY

[75] Inventors: Sergio Massirio, Finale Ligure; Massimo Bertoldi, Fossano; Giovanni Giusto, Altare; Emilio Prosperi, Genova Voltri; Roberto Sardelli, Savona, all of Italy

[73] Assignee: Imation Corp., Oakdale, Minn.

[21] Appl. No.: 862,118

[22] Filed: May 22, 1997

[30] Foreign Application Priority Data

Jun. 26, 1996 [EP] European Pat. Off. ..... 96110284

[51] Int. Cl.[6] ..... G03C 1/43; G03C 1/183; G03C 5/44

[52] U.S. Cl. ..... 430/510; 430/393; 430/430; 430/461

[58] Field of Search ..... 430/510, 393, 430/430, 461

[56] References Cited

U.S. PATENT DOCUMENTS

| | | | |
|---|---|---|---|
| 3,893,858 | 7/1975 | Wabnitz et al. | 430/393 |
| 4,163,669 | 8/1979 | Kanada et al. | 430/393 |
| 4,293,691 | 10/1981 | Furutachi et al. | 544/140 |
| 4,865,956 | 9/1989 | Harder et al. | 430/430 |
| 4,923,784 | 5/1990 | Harder et al. | 430/430 |
| 5,063,145 | 11/1991 | Sakanoue | 430/505 |
| 5,262,287 | 11/1993 | Deguchi et al. | 430/504 |
| 5,286,859 | 2/1994 | Begley et al. | 544/140 |
| 5,459,022 | 10/1995 | Ishii et al. | 430/549 |
| 5,464,733 | 11/1995 | Friday | 430/507 |
| 5,500,330 | 3/1996 | Szajewski et al. | 430/393 |
| 5,561,031 | 10/1996 | Bowne | 430/379 |

FOREIGN PATENT DOCUMENTS

| | | | |
|---|---|---|---|
| 0 193 389 A2 | 9/1986 | European Pat. Off. | G03C 7/32 |
| 0 566 416 A1 | 10/1993 | European Pat. Off. | G03C 7/30 |
| 55-029805 | 3/1980 | Japan | G03C 7/32 |

OTHER PUBLICATIONS

Research Disclosure –11449, Anonymous, "Bleach accelerator releasing couplers", Oct. 1973.

Research Disclosure –24241, Robert Follet, Antoch Vandengerghe and Plet Kok, "Compounds capable of releasing a development–influencing moiety", Jun. 1984.

*Primary Examiner*—Mark F. Huff

*Attorney, Agent, or Firm*—William K. Weimer

[57] ABSTRACT

A multilayer silver halide color photographic element comprises a support having coated thereon a silver antihalation layer, an interlayer, at least two red-sensitive silver halide emulsion layers, at least two green-sensitive silver halide emulsion layers a yellow filter layer, and at least two blue-sensitive silver halide emulsion layers, wherein the interlayer provided between the silver antihalation layer and the red-sensitive silver halide emulsion layer closest to the support contains a bleach accelerator releasing compound, and the silver antihalation layer contains a water-soluble organic thiol.

The invention provides reduction in residual silver levels and backside turbidity after processing, without deleteriously affecting sensitometric properties of the photographic element.

12 Claims, No Drawings

SILVER HALIDE COLOR PHOTOGRAPHIC ELEMENT HAVING IMPROVED BLEACHABILITY

FIELD OF THE INVENTION

This invention relates to silver halide color photographic elements, and in particular, to silver halide color photographic materials having improved speed of silver removal in bleaching and fixing steps (hereinafter referred to simply as "silver bleachability").

BACKGROUND OF THE INVENTION

In general, multilayer silver halide color photographic elements are processed by a color development step and a desilvering step after imagewise light exposure. In the color developing step, the imagewise exposed silver halides contained in the photographic element are reduced to metallic silver and at the same time the oxidized color developing agent contained in the color developer solution reacts with color forming couplers in the color photographic element to form dye images in the element. In the subsequent bleaching step, metallic silver thus formed is oxidized by a bleaching agent contained in the bleach solution, and the silver ion derived from bleaching, as well as the unexposed and undeveloped silver halide, are converted into a soluble silver complex by the action of a fixing agent contained in the fixing solution during the fixing step and dissolved away. Alternatively, the bleaching agent and the fixing agent can be combined in a bleach-fixing solution and the silver removed in one step by the use of such a solution.

Recently in this field, it has been found desirable to shorten the time required for photographic processing, in particular to shorten the post development desilvering step which consumes more than half of the overall processing time. However, juxtaposed with this trend to shorten processing time there is the problem that commercial bleaching solutions become generally less effective during use than initial fresh compositions. It particular, the effectiveness of the bleach solution is degraded by the carryover of the developer solution into the bleach solution, resulting in dilution and in increase of pH of the bleach solution. When bleaching time is shortened and effectiveness of the bleach bath is diminished, metallic silver retention occurs in the processed photographic element and quality of the resulting photographic image is reduced.

As a method of increasing the bleaching power and improving desilvering property, the use in photographic elements of bleach accelerating releasing (BAR) couplers is described, for example, in *Research Disclosure* 11449, JP 55-29805, U.S. Pat. No. 4,293,691, *Research Disclosure* 24241 and EP 193,389. The BAR couplers contain in the active coupling position a bleach accelerator moiety which is released during processing of the photographic element. Preferred bleach accelerator moieties are aliphatic and heterocyclic thiols.

Typically, multilayer silver halide color photographic elements comprise a support having coated thereon an antihalation layer, at least two red sensitive silver halide emulsion layers, at least two green sensitive silver halide emulsion layers, a yellow filter layer, and at least two blue sensitive silver halide emulsion layers. Since a satisfactory silver removal is required even when the silver is in a condition difficult for removal such as in the undermost silver halide layers (the ones nearest the support), BAR couplers are usually incorporated in the red sensitive silver halide emulsion layers.

EP 456,181 discloses multilayer color photographic elements including a unit of three adjacent red sensitive silver halide emulsion layers having a first red sensitive layer farthest from the support being more sensitive than a second or mid red sensitive layer which is more sensitive than a third red sensitive layer closest to the support. The examples disclose specifically use of BAR couplers in the most sensitive layer of the triple-coated unit.

Since the incorporation of BAR couplers to ensure adequate bleachability can have pronounced side effects on the sensitometric and color reproduction performance of the photographic element, EP 608,958 discloses the use of BAR couplers in the least sensitive red sensitive silver halide emulsion layer of three adjacent red sensitive silver halide emulsion layers. The same is also disclosed in EP 566,416 and 442,323.

U.S. Pat. No. 5,464,733 discloses a multilayer color photographic element comprising at least one of a bleach accelerator releasing coupler and a bleach accelerating silver salt in at least one layer of the photographic element and a layer containing finely divided silver. An interlayer is disposed between the layer containing finely divided silver and a layer containing dye forming coupler.

However, it has been found that when a multilayer color photographic silver halide element containing the BAR coupler is processed in the desilvering step to reduce residual silver, even small amounts of residual silver can generate an unpleasant turbidity in a backside inspection of the element (a bluish stain due to residual silver in the red sensitive silver halide emulsion layer, and a mirror-like surface due to residual silver in the antihalation layer). This turbidity can generate rejection of the film from printing equipment.

A problem to be solved is to provide a multilayer color photographic silver halide element which enables improved silver bleaching and reduced backside turbidity upon processing.

Various organic thiols have been also found to accelerate bleaching, as described for example in U.S. Pat. No. 3,893,858. U.S. Pat. No. 4,163,669 suggests that would be an advantage to incorporate the bleach accelerator directly in the photographic element but the incorporation of the free thiol would have adverse effects on the photographic properties of the element. Therefore, U.S. Pat. No. 4,163,669 discloses the incorporation in the photographic element of bleach accelerators, including the organic thiols of U.S. Pat. No. 3,893,858 as the salt of a heavy metal ion. EP 317,950 and U.S. Pat. No. 4,923,784 disclose photographic elements comprising a bleach accelerator precursor which is, respectively, a silver salt of a solubilized, non-primary amino thiol and a silver metal salt of an acid-containing, non-zwitterionic organic thiol.

SUMMARY OF THE INVENTION

The invention provides a multilayer silver halide color photographic element comprising a support having coated thereon a silver antihalation layer, an interlayer, at least two red-sensitive silver halide emulsion layers, at least two green-sensitive silver halide emulsion layers a yellow filter layer, and at least two blue-sensitive silver halide emulsion layers, wherein the interlayer provided between the silver antihalation layer and the red-sensitive silver halide emulsion layer closest to the support contains a bleach accelerator releasing compound, and the silver antihalation layer contains a water-soluble organic thiol.

The invention provides reduction in residual silver levels and backside turbidity after processing, without deleteriously affecting sensitometric properties of the photographic element.

DETAILED DESCRIPTION OF THE INVENTION

The bleach accelerator releasing compound can be any bleach accelerating releasing compound known in the photographic art. The bleach accelerator releasing compound can be represented by the formula:

$$A\text{-}(TIME)_n\text{-}Z$$

wherein A represents a group releasing from (TIME)n-Z upon reaction with the oxidation product of a color developing agent; TIME represents a timing group releasing Z with delay under developing conditions; n represents 0 or 1; and Z represents a group having a bleach accelerator effect when the A-$(TIME)_n$- bond is cleaved.

Preferably, the bleach accelerator releasing compound is represented by the formula:

$$A\text{-}(TIME)_n\text{-}S\text{—}R_1\text{—}R_2$$

wherein A represents a coupler residue or a redox compound; TIME and n are the same as defined above; $R_1$ is a divalent linking group, such as an alkylene group, especially a branched or straight chain alkylene group, containing 1 to 8 carbon atoms, or a heterocyclic group; and $R_2$ represents a water-solubilizing group, such as a carboxy group, a sulfo group, a hydroxy group or —$NR_3$—$R_4$, wherein $R_3$ and $R_4$, which may be the same or different, each represents a hydrogen atom or a substituted or unsubstituted aliphatic group having from 1 to 3 carbon atoms. The term "coupler residue" is herein defined as the residue of a color photographic coupler formed by the removal of a splitting off group from the coupler at the coupling position.

Examples of coupler residue represented by A are cyan coupler residues (e.g., phenolic coupler residues and naphtholic coupler residues, as described for example in U.S. Pat. Nos. 2,367,531; 2,423,730; 2,474,293; 2,772,162; 2,895,826; 3,002,836; 3,034,892; 3,041,236 and 4,883,746), magenta coupler residues (e.g., 5-pyrazolone type coupler residues, pyrazoloimidazole type coupler residues, and pyrazolotriazole type coupler residues, as described for example in U.S. Pat. Nos. 2,311,082; 2,343,703; 2,369,489; 2,600,788; 2,908,573; 3,062,653; 3,152,896; and 3,519,429), yellow coupler residues(e.g., open chain ketomethylene type coupler residues, as described for example in U.S. Pat. Nos. 2,298,443; 2,407,210; 2,875,057; 3,048,194; 3,265,506; and 3,447,928), and non-coloring coupler residues (e.g., indanone and acetophenone type coupler residues, as described for example in U.S. Pat. Nos. 3,632,345; 3,928,041; 3,958,993; 3,961,959; and GB 861,138).

Preferred coupler residues for use in this invention are those represented by one of the following formulae:

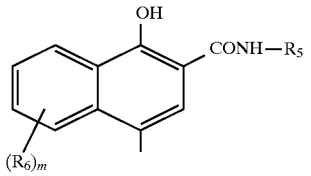

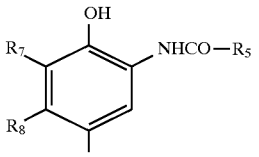

-continued

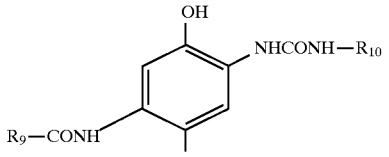

In each of the aforesaid formulae, the free bond at the coupling position is the bonding position of the coupler residue to $(TIME)_n$-Z. In the above formulae, $R_5$ and $R_9$ include as a non-diffusible group a ballasting ("Ball") group selected so that the total number of carbon atoms is from 8 to 32. $R_6$ represents a group capable of substituting a hydrogen atom of the naphthol ring; m represents 0 or an integer of from 1 to 3. $R_7$ represents hydrogen or a halogen atom, e.g., chlorine. $R_8$ is an alkyl group, e.g., methyl, ethyl, butyl, dodecyl, cyclohexyl. R10 is an aryl group, preferably a phenyl group, more preferably a phenyl group having at least one substituent selected from the class consisting of trifluoromethyl, cyano, —COR', —COOR', —$SO_2$R', —$SO_2$OR', —CONR'R", —$SO_2$NR'R", —OR', and —OCOR', wherein R' is an aliphatic or an aromatic group and R" is hydrogen, an aliphatic or an aromatic group.

Examples of $R_6$ include halogen, hydroxy, amino, carboxyl, sulfo, cyano, aromatic group, heterocyclic group, carbonamido, sulfonamido, carbamoyl, sulfamoyl, ureido, acyl, acyloxy, and the like. When $R_6$ is a group capable of substituting the hydrogen atom of the naphthol ring in position 5 relative to the hydroxy group, suitable groups for $R_6$ are those described in U.S. Pat. No. 4,690,998, incorporated herein by reference.

Examples of $R_{10}$ include 4-cyanophenyl, 2-cyanophenyl, 3-chloro-4cyanophenyl, 4-butylsulfophenyl, 4-ethoxycarbonylphenyl and 4-N,N-diethylsulfamoylphenyl.

TIME is a timing group joining the coupler residue to the Z group, which is released together with the Z group on coupling reaction with the oxidation product of a color developing agent and which, in turn, releases the Z group with delay under development conditions. Examples of timing groups represented by TIME include, for example, the following groups:

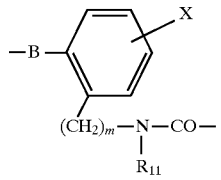

wherein B is oxygen or sulfur and is attached to the coupler moiety, m is 0 or 1, $R_{11}$ is hydrogen or an alkyl of 1 to 4 carbon atoms or an aryl of 6 to 10 carbon atoms, X is hydrogen, halogen, cyano, nitro, alkyl of 1 to 20 carbon atoms, alkoxy, alkoxycarbonyl, acylamino, aminocarbonyl, etc., as described in U.S. Pat. No. 4,248,962,

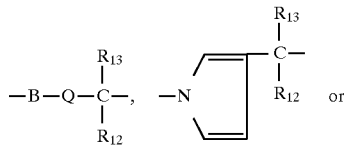

-continued

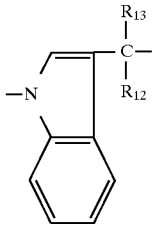

wherein the left hand side is attached to coupler moiety, B is oxygen or sulfur or

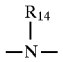

$R_{12}$, $R_{13}$ and $R_{14}$ are individually hydrogen, alkyl or aryl groups, and Q is a 1,2- or 1,4-phenylene or naphthylene group, as described in U.S. Pat. No. 4,409,323.

In the above formula, the ballasting group is an organic group of such size and configuration as to render a group to which is attached non-diffusible from the layer in which is coated in a photographic element. Said ballasting group includes, for example, an organic hydrophobic residue having 8 to 32 carbon atoms bonded to the coupler either directly or through a divalent linking group such as, for example, an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337,344, 3,418,129, 4,138,258, and 4,451,559, and in GB 1,494,777.

When A in the formula above for the bleach accelerator releasing compound is a redox compound, A is preferably represented by the formula

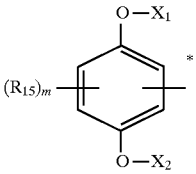

wherein $X_1$ and $X_2$, which may be the same or different, each represents a hydrogen atom or a group capable of being removed upon reaction with an alkaline substance such as a group capable of being hydrolyzed (e.g., an acyl group, an alkoxycarbonyl group, an aryloxycarbonyl group, a carbamoyl group, and a sulfamoyl group), or a precursor group as described for example in U.S. Pat. Nos. 3,674,478, 3,932,480, 3,993,661, 4,009,029, 4,310,612, 4,335,200, 4,363,865, and 4,410,618; $R_{15}$ represents a substituent, such as an alkyl group (e.g., methyl, ethyl, butyl, and octyl), an alkoxy group (e.g., methoxy), an alkylthio (e.g., methylthio, dodecylthio), a carbamoyl group (e.g., propylcarbamoyl, N-methyl-N-octadecylcarbamoyl), an alkoxycarbonyl group (e.g., methoxycarbonyl, dodecyloxycarbonyl), and the like; m is an integer from 0 to 3; and * represents a position of bonding to $(TIME)_n$-Z.

When the term "group", is used in this invention to describe a chemical compound or substituent, the described chemical material includes the basic group, ring or residue and that group, ring or residue with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen cyano, hydroxyl, nitro, amino, carboxylate, etc. On the other hand, "alkyl moiety" includes only methyl, ethyl, stearyl, cyclohexyl, etc.

Specific examples of compounds releasing bleach accelerator useful in this invention are illustrated below but, but the invention is not limited to these compounds.

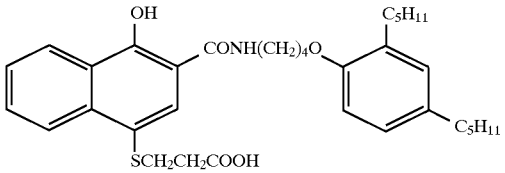

(I-1)

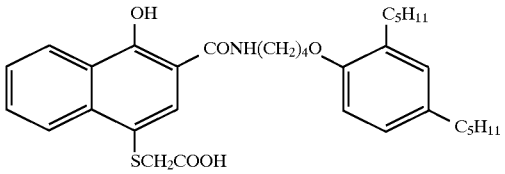

(I-2)

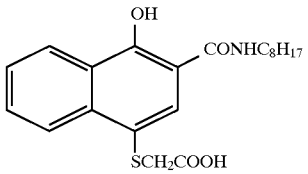

(I-3)

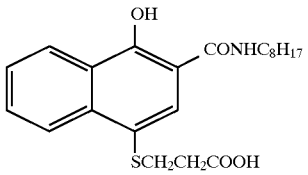

(I-4)

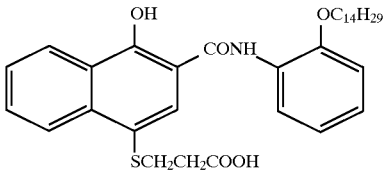

(I-5)

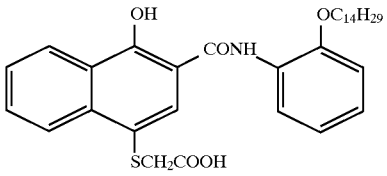

(I-6)

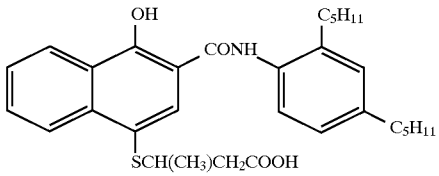

(I-7)

-continued (I-8)

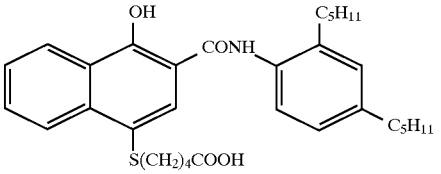

(I-9)

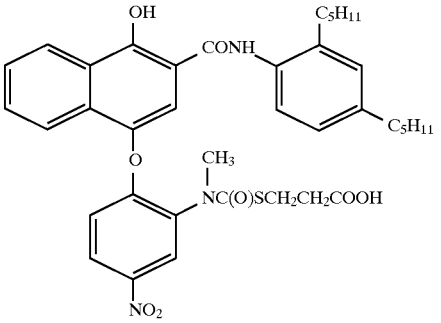

(I-10)

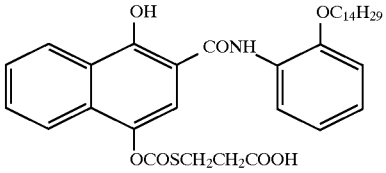

(I-11)

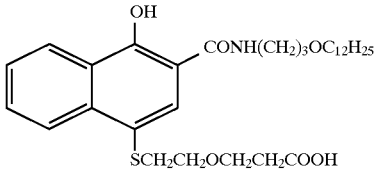

(I-12)

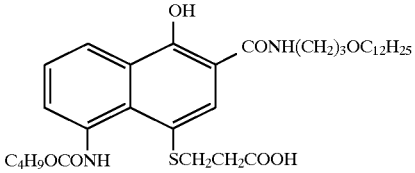

(I-13)

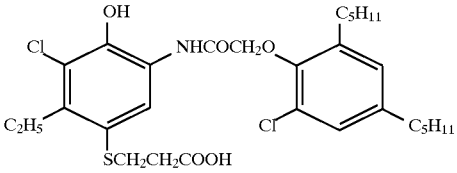

(I-14)

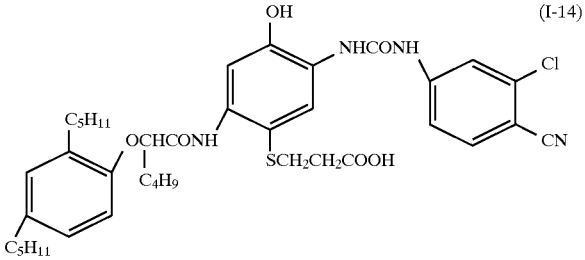

(I-15)

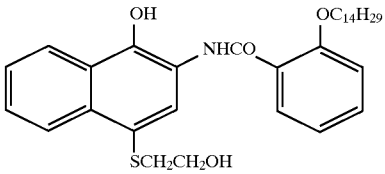

-continued (I-16)

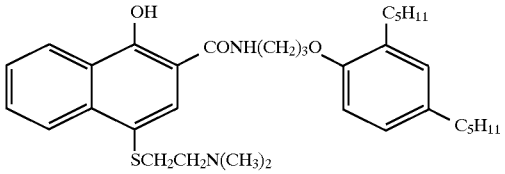

(I-17)

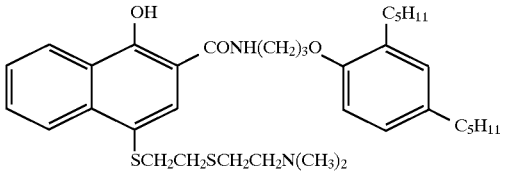

(I-18)

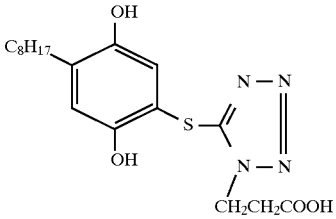

(I-19)

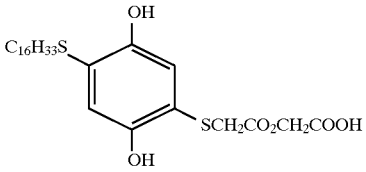

(I-20)

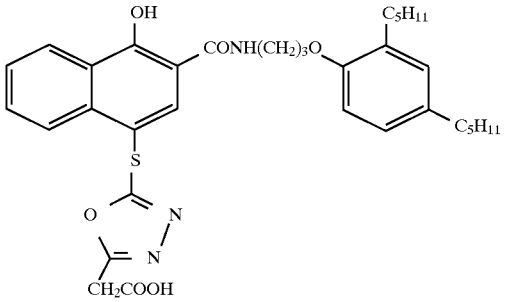

The bleach accelerator releasing compound is contained in the gelatin interlayer provided between the silver antihalation layer and the red-sensitive silver halide emulsion layer closest to the support. The addition amount of the bleach accelerator releasing compound for use in this invention to the interlayer is from 0.010 to 0.10 g, and preferably from 0.020 to 0.070 g per square meter of the photographic element.

The water-soluble organic thiols for use in this invention include aliphatic and heterocyclic thiol compounds containing a water-solubilizing group which do not form zwitterionic moieties. Suitable water-soluble organic thiols are acid-containing, hydroxy-containing or amine-containing non-zwitterionic aliphatic or heterocyclic thiol compounds.

Specific examples of organic thiols for use in this invention are illustrated below, but the invention is not limited to these compounds.

$HSCH_2CH_2COOH$ (II-1)

$HSCH_2COOH$ (II-2)

$HSCH_2CH_2OCH_2CH_2COOH$ (II-3)

$HSCH_2CH_2SCH_2CH_2COOH$ (II-4)

$HSCH(CH_3)CH_2COOH$ (II-5)

$HSCH_2CH_20CH_2CH_2COOH$ (II-6)

$HSCH_2CO_2CH_2COOH$ (II-7)

$HSCH_2CH_20CH_2CH_2OH$ (II-8)

$HSCH_2CH_20CH_2CH_2N(CH_3)_2$ (II-9)

$HSCH_2CH_2N(CH_3)_2$ (II-10)

$HSCH_2CH_2N(CH_2CH_2OCH_3)_2$ (II-11)

(II-12)

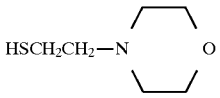

(II-13)

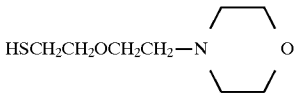

(II-14)

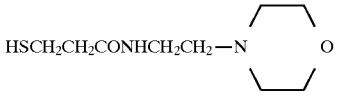

(II-15)

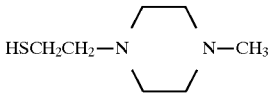

(II-16)

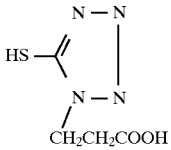

The organic thiol is contained in the gelatin antihalation layer provided adjacent the support. The antihalation layer can contain very fine gray or black silver filamentary or colloidal silver, and preferably UV absorbing dyes and colored dyes. The addition amount of the free organic thiol for use in this invention to the silver antihalation layer is from about 0.00005 to 0.001 grams, preferably from 0.0001 to 0.0005 grams per square meter of the photographic element.

The multilayer silver halide color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chlorobromide, silver iodo-bromide and silver chloro-iodobromide grains in a hydrophilic binder. Preferred silver halides are silver iodo-bromide or silver iodo-bromochloride containing 1 to 20% mole silver iodide. In silver iodo-bromide emulsions or silver iodo-bromo-chloride, the iodide can be uniformly distributed among the emulsion grains, or iodide level can varied among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" according to the present invention is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 $\mu$m, more preferably from 0.4 to 1.5 $\mu$m. Preparation of silver halide emulsions comprising cubic silver iodobromide grains is described, for example, in Research Disclosure, Vol. 184, Item 18431, Vol. 176, Item 17644 and Vol. 308, Item 308119.

Other silver halide emulsions for use in this invention are those which employ one or more light-sensitive tabular grain emulsions. The tabular silver halide grains contained in the emulsion of this invention have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains suitable for use in this invention range from about 0.3 $\mu$m to about 5 $\mu$m, preferably 0.5 $\mu$m to 3 $\mu$m, more preferably 0.8 $\mu$m to 1.5 $\mu$m. The tabular silver halide grains suitable for use in this invention have a thickness of less than 0.4 $\mu$m, preferably less than 0.3 $\mu$m and more preferably less than 0.2 $\mu$m.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 $\mu$m, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, 3,979,213, Research Disclosure, December 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, GB 1,302,405, U.S. Pat. No. 3,801,326, U.S. Pat. No. 4,046,376, U.S. Pat. No. 3,790,386, U.S. Pat. No. 3,897,935, U.S. Pat. No. 4,147,551, and U.S. Pat. No. 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions for use in the present invention, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, polyacrylamide, etc. Other hydrophilic materials useful known in the art are described, for example, in Research Disclosure, Vol. 308, Item 308119, Section IX.

The silver halide grain emulsion for use in the present invention can be chemically sensitized using sensitizing agents known in the art. Sulfur containing compounds, gold and noble metal compounds, and polyoxylakylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion for use in the present invention can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes*, Academic Press, New York, 1971, Chapter V, James, *The Theory of the Photographic Process,* 4th Ed., Macmillan, 1977, Chapter 8, F. M. Hamer, *Cyanine Dyes and Related Compounds*, John Wiley and Sons, 1964, and in Research Disclosure 308119, Section III, 1989.

The silver halide emulsions for use in this invention can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII , 1978, and in Research Disclosure 308119, Sections V, VI, VIII, X, XI, and XII, 1989.

The silver halide emulsion for use in the present invention can be used for the manufacture of multilayer light-sensitive silver halide color photographic elements, such as color negative photographic elements, color reversal photographic elements, color positive photographic elements, false color address photographic elements (such as those disclosed in U.S. Pat. No. 4,619,892) and the like, the preferred ones being color negative photographic elements.

Silver halide multilayer color photographic elements usually comprise, coated on a support, a red sensitized silver halide emulsion layer associated with cyan dye-forming color couplers, a green sensitized silver halide emulsion layer associated with magenta dye-forming color couplers and a blue sensitized silver halide emulsion layer associated with yellow dye-forming color couplers. Each layer is usually comprised of multiple (two or more) emulsion sub-layers sensitive to a given region of visible spectrum. When multilayer materials contain multiple blue, green or red sub-layers, these can be in any case relatively faster and relatively slower sub-layers. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in a layer arrangement comprising the red-sensitive layers coated nearest the support and overcoated by the green-sensitive layers, a yellow filter layer and the blue-sensitive layers.

Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an a-naphthol compound, is associated with red-sensitive silver halide emulsion layers, at least one non-diffusible magenta image-forming color coupler, generally a 5-pyrazolone or a pyrazolotriazole compound, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and a-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in British patent 1,201,110, and in Research Disclosure 308119, Section VII, 1989.

The most useful magenta-forming couplers are conventional pyrazolone type compounds, indazolone type compounds, cyanoacetyl compounds, pyrazolotriazole type compounds, etc, and particularly preferred couplers are pyrazolone type compounds. Magenta-forming couplers are described for example in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, in DE patent 1,810,464, in DE patent applications 2,408,665, 2,417,945, 2,418,959 and 2,424,467; in JP patent applications 20,826/76, 58,922/77, 129,538/74, 74,027/74, 159,336/75, 42,121/77, 74,028/74, 60,233/75, 26,541/76 and 55,122/78, and in Research Disclosure 308119, Section VII, 1989.

The most useful yellow-forming couplers which can be used in combination with the yellow dye-forming couplers described hereinbefore are conventional open-chain ketomethylene type couplers. Particular examples of such couplers are benzoyl acetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652, 3,528,322, 3,551,151, 3,682,322, 3,725,072 and 3,891,445, in DE patents 2,219,917, 2,261,361 and 2,414,006, in GB patent 1,425,020, in JP patent 10,783/76 and in JP patent applications 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

Colored couplers can be used which include those described for example in U.S. Pat. Nos. 3,476,560, 2,521,908 and 3,034,892, in JP patent publications 2,016/69, 22,335/63, 11,304/67 and 32,461/69, in JP patent applications 26,034/76 and 42,121/77 and in DE patent application 2,418,959. The light-sensitive silver halide color photographic element may contain high molecular weight color couplers as described for example in U.S. Pat. No. 4,080,211, in EP Pat. Appl. No. 27,284 and in DE Pat. Appl. Nos. 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, colored magenta couplers can be selected from the colored magenta couplers described in U.S. Pat. Nos. 2,434,272; 3,476,564 and 3,476,560 and in British patent 1,464,361. Colorless couplers can be selected from those described in British patents 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB Pat. No. 2,125,570 and yellow, magenta and cyan couplers described in EP Pat. No. 96,873, in DE Pat. Appl. No. 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator, either directly or after removal of one or further groups from the group originally released. Examples of such 2-equivalent couplers include the known DIR couplers as well as DAR and FAR couplers. Typical examples of said couplers are described in DE Pat. Appl. Nos. 2,703,145, 2,855,697, 3,105,026, 3,319,428, 1,800,420, 2,015,867, 2,414,006, 2,842,063, 3,427,235, 3,209,110, and 1,547,640, in GB Pat. Nos. 953,454 and 1,591,641, in EP Pat. Appl. Nos. 89,843, 117,511, 118,087, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German patent applications S.N. 2,405,442; 2,523,705; 2,460,202; 2,529,350 and 2,448,063; in Japanese patent applications S.N. 143,538/75 and 147,716/75, in British patents 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE patents 853,512 and 869,816, in U.S. Pat. Nos. 4,214,047 and 4,199,363 and in EP patent 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention, may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylendiamine derivatives, widely employed in various color photographic process. Particularly useful color developing agents are the p-phenylendiamine derivatives, especially the N,N-dialkyl-p-phenylene diamine derivatives wherein the alkyl groups or the aromatic nucleus can be substituted or not substituted.

Examples of p-phenylene diamine developers include the salts of: N,N-di-ethyl-p-phenylendiamine, 2-amino-5-diethylamino-toluene, 4-amino-N-ethyl-N-(amethanesulphonamidoethyl)-m-toluidine, 4-amino-3-methyl-N-ethyl-N-(a-hydroxyethyl)-aniline, 4-amino-3-(a-methylsulfonamidoethyl)-N,N-diethylaniline, 4-amino-N,N-diethyl-3-(N'-methyl-a-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(a-methanesulfonamidoethyl)-m-toluidine sesquisulfate monohydrate (generally known as CD3 and used in the developing solution for photographic papers and color reversal materials) and 4-amino-3methyl-N-ethyl-N-(b-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., $EDTA.Fe.NH_4$, wherein EDTA is the ethylenediamino-tetracetic acid, or $PDTA.Fe.NH_4$, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but it should be understood that these examples do not limit the present invention.

EXAMPLE 1

A multilayer color photographic material (Sample 101) was prepared having the layers of the following compositions coated on a transparent cellulose acetate film support having a gelatin subbing layer. In the following compositions, the coating amounts of silver halides, gelatin and other additives are reported in grams per square meter ($g/m^2$). All silver halide emulsions were stabilized with 4-hydroxy-6-methyl-1,3,3a,7-tetrazaindene and spectrally sensitized with the appropriate spectral red, green and blue sensitizing dyes.

| | |
|---|---|
| Layer 1 (Antihalation Layer) | |
| Black colloidal silver | 0.180 |
| Gelatin | 1.320 |
| Dye 1 | 0.022 |
| Dye 2 | 0.020 |
| Solv-1 | 0.060 |
| Layer 2 (Interlayer) | |
| Gelatin | 1.080 |
| Dye 1 | 0.016 |
| Cpd-1 | 0.051 |
| UV-1 | 0.056 |
| UV-2 | 0.056 |
| Solv-1 | 0.100 |
| Layer 3 (Least Red-Sensitive Emulsion Layer) | |
| Silver Iodobromide Emulsion (AgI 2.5 mol %, average diameter 0.22 mm) | 0.750 |
| Gelatin | 1.350 |
| Cyan coupler C-1 | 0.372 |
| DIR Coupler D-1 | 0.022 |
| Cyan Masking Coupler CM-1 | 0.028 |
| Dye 1 | 0.013 |
| Dye 2 | 0.004 |
| Solv-2 | 0.583 |
| Solv-3 | 0.250 |
| Layer 4 (Mid Red-Sensitive Emulsion Layer) | |
| Silver Iodobromide Emulsion (AgI 6 mol % average diameter 0.60 mm) | 0.750 |
| Gelatin | 0.720 |
| Cyan coupler C-1 | 0.250 |
| DIR Coupler D-1 | 0.015 |
| Cyan Masking Coupler CM-1 | 0.048 |
| Dye 1 | 0.09 |
| Solv-2 | 0.408 |
| Solv-3 | 0.175 |
| Layer 5 (Most Red-Sensitive Emulsion Layer) | |
| Silver Iodobromide Emulsion (AgI 12 mol % average diameter 1.30 mm) | 1.600 |
| Gelatin | 1.120 |
| Cyan coupler C-1 | 0.248 |
| Cyan Coupler C-2 | 0.039 |
| DIR Coupler D-1 | 0.021 |
| Cyan Masking Coupler CM-1 | 0.013 |
| Dye 1 | 0.002 |
| Solv-1 | 0.200 |
| Solv-4 | 0.200 |
| Layer 6 (Interlayer) | |
| Gelatin | 1.210 |
| Cpd-1 | 0.091 |
| Solv-4 | 0.110 |
| Hardener H-1 | 0.077 |
| Layer 7 (Least Green-Sensitive Layer) | |
| Silver Iodobromide Emulsion (AgI 2.5 mol % average diameter 0.22 mm) | 0.770 |
| Gelatin | 1.490 |
| Magenta Coupler M-1 | 0.407 |
| DIR Coupler D-2 | 0.017 |
| Magenta Masking Coupler MM-1 | 0.078 |
| Magenta Masking Coupler MM-2 | 0.039 |
| Cpd-1 | 0.010 |
| Solv-4 | 0.526 |
| Layer 8 (Mid Green-Sensitive Layer) | |
| Silver Iodobromide Emulsion (AgI 6.0 mol %, average diameter 0.60 mm) | 1.000 |
| Gelatin | 1.320 |
| Magenta Coupler M-1 | 0.044 |
| DIR Coupler D-2 | 0.050 |
| Magenta Masking Coupler MM-1 | 0.078 |
| Magenta Masking Coupler MM-2 | 0.039 |
| Cpd-1 | 0.011 |
| Solv-4 | 0.200 |
| Layer 9 (Most Green-Sensitive Layer) | |

-continued

| | |
|---|---|
| Silver Iodobromide Emulsion (AgI 12.0 mol %, average diameter 1.30 mm) | 1.710 |
| Gelatin | 1.430 |
| Magenta Coupler M-1 | 0.328 |
| DIR Coupler D-2 | 0.002 |
| Magenta Masking Coupler MM-1 | 0.036 |
| Magenta Masking Coupler MM-2 | 0.018 |
| Cpd-1 | 0.027 |
| Solv-4 | 0.300 |
| Layer 10 (Interlayer) | |
| Gelatin | 1.210 |
| Layer 11 (Yellow Filter Layer) | |
| Gelatin | 1.070 |
| Yellow Colloidal Silver | 0.039 |
| Hardener H-1 | 0.067 |
| Layer 12 (Least Blue-Sensitive Layer) | |
| Silver Iodobromide Emulsion (AgI 2.5 mol %, average diameter 0.22 mm) | 0.303 |
| Silver Iodobromide Emulsion (AgI 6.0 mol %, average diameter 0.60 mm) | 0.248 |
| Gelatin | 1.320 |
| Yellow Coupler Y-1 | 0.962 |
| DIR Coupler D-3 | 0.051 |
| Solv-5 | 0.288 |
| Solv-1 | 0.288 |
| Layer 12 (Most Blue-Sensitive Layer) | |
| Silver Iodobromide Emulsion (AgI 12 mol %, average diameter 1.20 mm) | 0.890 |
| Gelatin | 1.180 |
| Yellow Coupler Y-1 | 0.300 |
| DIR Coupler D-3 | 0.033 |
| Cyan Coupler C-2 | 0.026 |
| Solv-5 | 0.088 |
| Solv-1 | 0.088 |
| Layer 14 (First Protective Layer) | |
| Unsensitized Silver Bromide Lippmann Emulsion | 0.230 |
| Gelatin | 1.260 |
| UV-1 | 0.108 |
| UV-2 | 0.108 |
| Cpd-2 | 0.148 |
| Layer 15 (Second Protective Layer) | |
| Gelatin | 0.880 |
| Matte Polymethylmethacrylate Beads | 0.014 |
| Matte Copoly(ethylmethacrylate-methacrylic acid) | 0.181 |
| Hardener H-2 | 0.425 |

Multilayer color photographic materials (Samples 102–104) were prepared in the same manner as Sample 101 except that bleach accelerator releasing coupler I-1 and water soluble mercapto compound II-1 were added to the layer 1 (antihalation layer) and to layer 2 (interlayer) as shown in Table 1.

Samples 102–104 were individually exposed to white light of a color temperature of 5500K and then processed in accordance with the Kodak C-41 color negative process (as described in British Journal of Photography Annual, pp. 196–198, 1988). Excellent results in sensitometric properties (e.g., maximum density, minimum density, speed and contrast) were obtained with all samples.

A second set of Samples 101–104 was exposed to white light at 5000K and subjected to color negative processing using the Kodak C-41 process using EDTA.Na.Fe as bleaching agent and reducing the bleaching time from the standard time of 4'20" to 3'16". Thereafter, the amount of silver remaining in each sample was determined by X-ray fluorescence spectroscopy. The results thereof are shown in Table 1 below.

TABLE 1

| Sample | THIOL in Layer 1 ($mg/m^2$) | BARC in Layer 2 ($g/m^2$) | Retained Silver ($g/m^2$) | Backside Stain |
|---|---|---|---|---|
| 101 | / | / | 0.19 | Low (cyan layer)<br>Medium (layer 1) |
| 102 | II-1 (0.31) | / | 0.18 | Low (cyan layer) |
| 103 | / | I-1 (50) | 0.09 | Strong (layer 1) |
| 104 | II-1 (0.31) | I-1 (50) | 0.10 | Low (cyan layer) |

The results listed in Table 1 show that the combination of a bleaching accelerating releasing coupler in the interlayer and an organic thiol in the antihalation layer reduces residual silver and backside color stain, while the bleaching accelerating releasing coupler used alone causes a strong increase of the backside stain and the organic thiol used alone does not reduce residual silver.

Formulas for the compounds used in the Examples are as follows.

Dye 1:

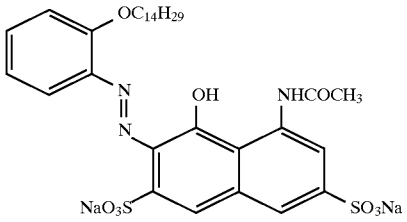

Dye 2:

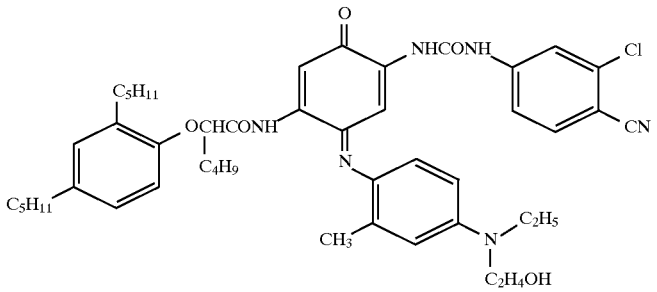

Cpd-1:

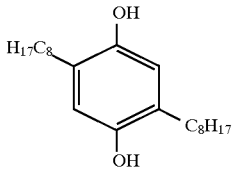

UV-1:

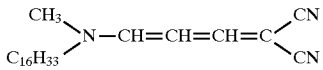

UV-2:

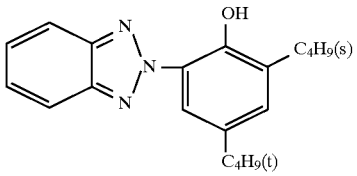

-continued
Cyan Coupler C-1:
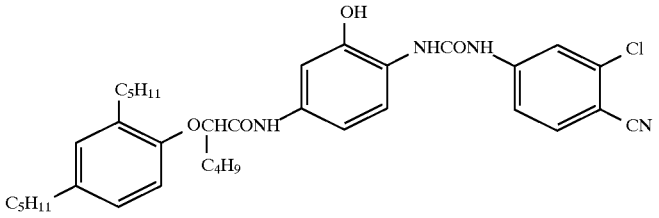
Cyan Coupler C-2:
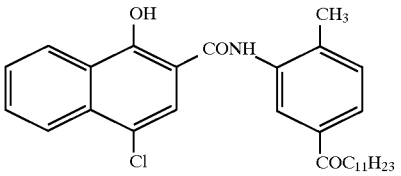
Cyan Masking Coupler CM-1:
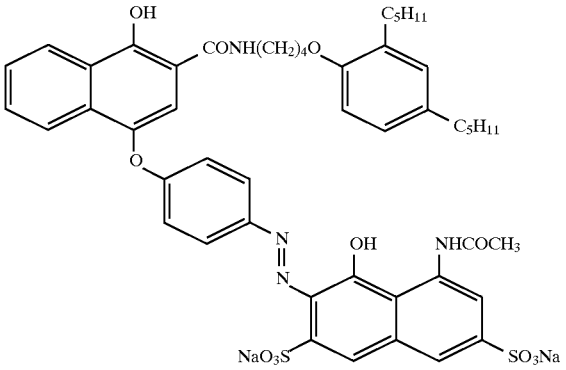
DIR Coupler D-1:
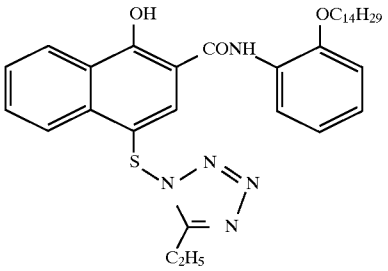
Solv-1: N-Butylacetanilide
Solv-2: Triphenyl Phosphate
Solv-3: Dibutylphthalate
Solv-4: Tricresyl Phosphate
Solv-5: Bis-(2-ethylhexyl)-phthalate
Hardener H-1:
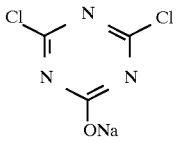

-continued
Magenta Coupler M-1:
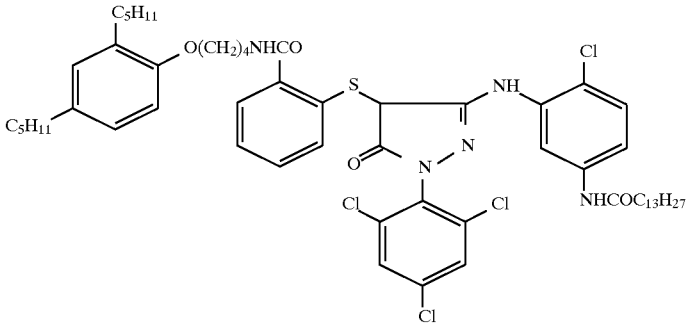
Magenta Coupler M-2:
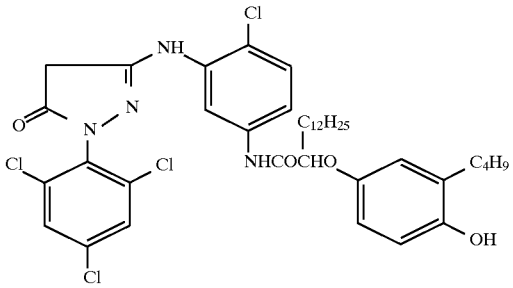
DIR Coupler D-2:
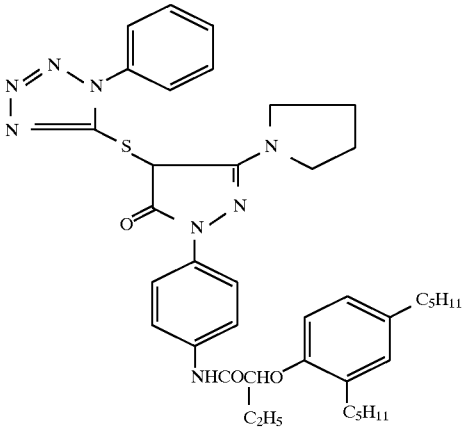
Magenta Masking Coupler MM-1:
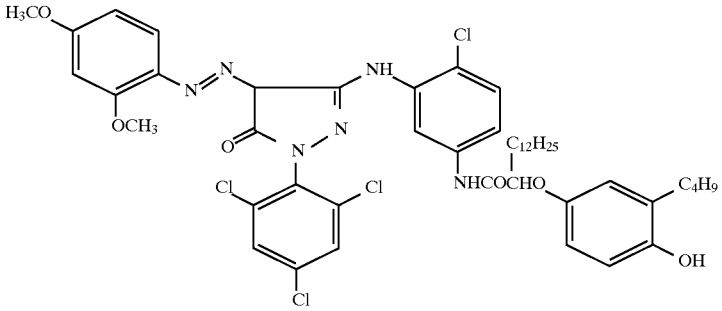

-continued

Magenta Masking Coupler MM-2:

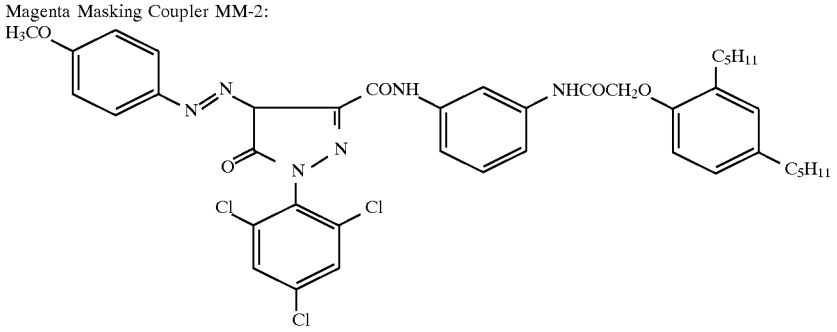

Yellow Coupler Y-1:

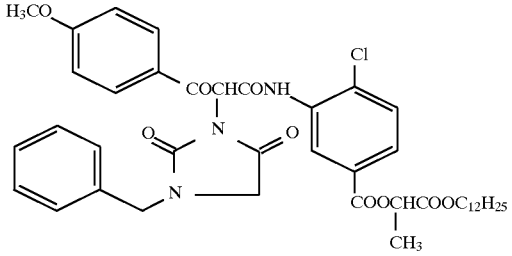

DIR Coupler D-3:

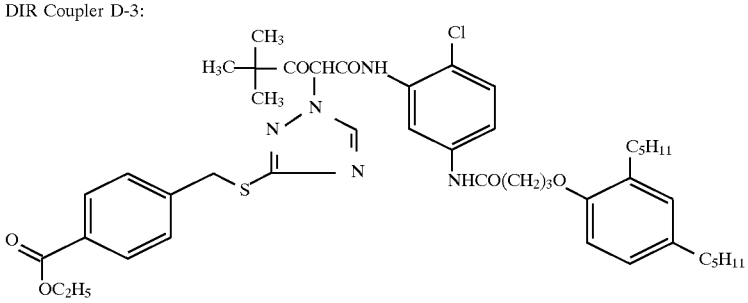

Cpd-2:
$(-CH_2NHCONH_2)_2$

Hardener H-2:

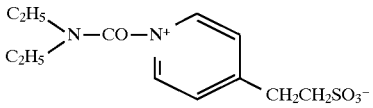

EXAMPLE 2

A multilayer color photographic material (Sample 201) was prepared by following the same procedure as in Example 1 for preparing Sample 101. Multilayer color photographic materials (Samples 202–204) were prepared in the same manner as Sample 201 except that bleach accelerator releasing coupler I-1 and water-soluble thiol compound II-1 were added to layer 1 (antihalation layer), to layer 2 (interlayer) and to layer 5 (most red-sensitive emulsion layer) as shown in Table 2 below.

TABLE 2

| Sample | THIOL in Layer 1 ($mg/m^2$) | BARC in Layer 2 ($mg/m^2$) | BARC in Layer 5 ($mg/m^2$) |
|---|---|---|---|
| 201 | / | / | / |
| 202 | II-1 (0.31) | / | / |
| 203 | / | / | I-1 (72) |
| 204 | II-1 (0.31) | I-1 (50) | / |

Samples 201–204 were individually exposed to white light of a color temperature of 5500K and then processed in accordance with the Kodak C-41 color negative process (as described in British Journal of Photography Annual, pp. 196–198, 1988). Excellent results in sensitometric properties ( e.g., maximum density, minimum density, speed and contrast) were obtained with all samples, with the exception of Sample 203 wherein the presence of the bleach accelerating releasing coupler in the red-sensitive silver halide emulsion layer resulted in negative side effects on the sensitometric performance of the element, as disclosed also in EP 608,958.

Samples 201–204 were exposed to white light at 5000K and subjected to color negative processing using the Kodak C-41 process wherein the standard C41 bleaching solution, containing PDTA.Na.Fe bleaching agent, was diluted with 3 parts of water and the bleaching time was reduced from the standard time of 4'20" to 2'30", respectively. Thereafter, the amount of silver remaining in each sample was determined by X-ray fluorescence spectroscopy. The results thereof are shown in Table 3 below.

TABLE 3

| | 2' BLEACH TIME | | 2'30" BLEACH TIME | |
|---|---|---|---|---|
| SAMPLE | Retained Silver ($g/m^2$) | Backside Stain | Retained Silver ($g/m^2$) | Backside Stain |
| 201 | 0.26 | S (layer 1) | 0.09 | M (cyan layer) L (layer 1) |
| 202 | 0.24 | S (cyan layer) M (layer 1) | 0.05 | L (cyan layer) |
| 203 | 0.14 | VS (layer 1) | 0.01 | Absent |
| 204 | 0.15 | M (cyan layer) | 0.01 | Absent |

VS = Very Strong. S = Strong. M = Medium. L = Low

EXAMPLE 3

A multilayer color photographic material (Sample 301) was prepared by following the same procedure as in Example 1 for preparing Sample 101. Multilayer color photographic materials (Sample 302 and 303) were prepared in the same manner as Sample 301 except that bleach accelerator releasing couplers I-1 and I-2 and water-soluble thiol compound II-1 were added to the layer 1 (antihalation layer) and to layer 2 (interlayer) as shown in Table 4 below.

TABLE 4

| Sample | THIOL in Layer 1 ($mg/m^2$) | BARC in Layer 2 ($mg/m^2$) |
|---|---|---|
| 301 | / | / |
| 302 | II-1 (0.31) | I-2 (60) |
| 303 | II-1 (0.31) | I-1 (40) |

Samples 301–303 were individually exposed and processed as described in Example 1. Excellent results in sensitometric properties (e.g., maximum density, minimum density, speed and contrast) were obtained with all samples. Residual silver and backside stain of the samples processed in non standard bleaching solution as described in Example 1 are shown in Table 5 below.

TABLE 5

| Sample | Retained Silver ($g/m^2$) | Backside Stain |
|---|---|---|
| 301 | 0.16 | Low (cyan layer) |
| 302 | 0.11 | Low (cyan layer) |
| 303 | 0.11 | Low (cyan layer) |

What is claimed is:

1. A multilayer silver halide color photographic element comprising a support having coated thereon a silver antihalation layer, an interlayer, at least two red-sensitive silver halide emulsion layers, at least two green-sensitive silver halide emulsion layers a yellow filter layer, and at least two blue-sensitive silver halide emulsion layers, wherein the interlayer provided between the silver antihalation layer and the red-sensitive silver halide emulsion layer closest to the support contains a bleach accelerator releasing compound, and the silver antihalation layer contains a water-soluble organic thiol.

2. The photographic element of claim 1 wherein the bleach accelerator releasing compound is represented by the formula $$A(TIME)_n\text{-}Z$$

wherein A represents a group releasing from (TIME)n-Z upon reaction with the oxidation product of a color developing agent; TIME represents a timing group releasing Z with delay under developing conditions; n represents 0 or 1; and Z represents a group having a bleach accelerator effect when the A-$(TIME)_n$- bond is cleaved.

3. The photographic element of claim 2 wherein A represents a coupler residue or a redox compound.

4. The photographic element of claim 3 wherein the coupler residue is selected within the group consisting of yellow dye-forming coupler residues, magenta dye-forming coupler residues, cyan dye-forming coupler residues and non-coloring coupler residues.

5. The photographic element of claim 4 wherein the cyan dye-forming coupler residues are represented by one of the formulae

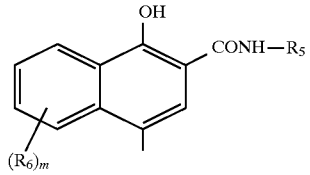

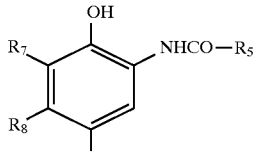

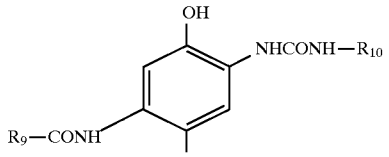

wherein the free bond at the coupling position of each formula is the bonding position of the coupler residue to $(TIME)_n$-Z, $R_5$ and $R_9$ represent a non-diffusible ballasting group, $R_6$ represents a group capable of substituting a hydrogen atom of the naphthol ring, m represents 0 to 3, $R_7$ represents hydrogen or a halogen atom, $R_8$ represents an alkyl group, and R10 represents an aryl group.

6. The photographic element of claim 3 wherein the redox compound is represented by the formula

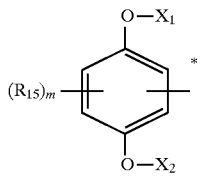

wherein $X_1$ and $X_2$, which may be the same or different, each represents a hydrogen atom or a group capable of being removed upon reaction with an alkaline substance, $R_{15}$ represents a substituent, m is an integer from 0 to 3, and * represents a position of bonding to $(TlME)_n$-Z.

7. The photographic element of claim 1 wherein said bleach accelerator releasing compound has the formula

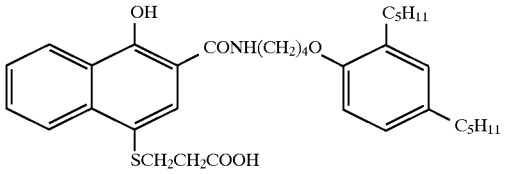

8. The photographic element of claim 1 wherein said bleach accelerator releasing coupler has the formula

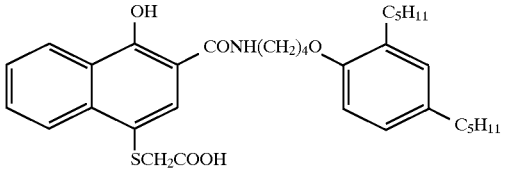

9. The photographic element of claim 1 wherein said compound releasing a bleach accelerator is present in said interlayer in an amount of 0.020 to 0.070 grams per square meter of the photographic element.

10. The photographic element of claim 1 wherein said water-soluble organic thiol is selected within the group consisting of acid-containing, hydroxy-containing and non-basic amine containing non-zwitterionic aliphatic and heterocyclic thiol compounds.

11. The photographic element of claim 1 wherein said water-soluble organic thiol is present in said silver antihalation layer in an amount of 0.0001 to 0.0005 grams per square meter of the photographic element.

12. The photographic element of claim 1 wherein said water-soluble organic thiol has the formula $HSCH_2CH_2COOH$.

* * * * *